US007036754B2

(12) United States Patent
Stoecklein et al.

(10) Patent No.: US 7,036,754 B2
(45) Date of Patent: May 2, 2006

(54) INJECTION VALVE

(75) Inventors: Wolfgang Stoecklein, Stuttgart (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 5 days.

(21) Appl. No.: 10/296,582

(22) PCT Filed: Mar. 26, 2002

(86) PCT No.: PCT/DE02/01092

§ 371 (c)(1),
(2), (4) Date: Apr. 11, 2003

(87) PCT Pub. No.: WO02/079636

PCT Pub. Date: Oct. 10, 2002

(65) Prior Publication Data

US 2003/0168527 A1 Sep. 11, 2003

(30) Foreign Application Priority Data

Mar. 29, 2001 (DE) ..... 101 15 649

(51) Int. Cl.
*F02M 59/00* (2006.01)

(52) U.S. Cl. ..... 239/533.2; 239/88; 239/585.1; 239/600

(58) Field of Classification Search ..... 239/88, 239/533.2, 585.1, 89, 90, 92, 600
See application file for complete search history.

(56) References Cited

U.S. PATENT DOCUMENTS

| | | | | | |
|---|---|---|---|---|---|
| 3,716,922 | A | * | 2/1973 | Shaver | 33/607 |
| 4,413,937 | A | * | 11/1983 | Gutsche | 408/239 A |
| 4,541,206 | A | * | 9/1985 | Akhavi | 451/384 |
| 4,720,903 | A | * | 1/1988 | Landa | 29/243.517 |
| 5,680,845 | A | * | 10/1997 | Peng | 123/470 |

FOREIGN PATENT DOCUMENTS

| | | | |
|---|---|---|---|
| DE | 19951014 A | * | 1/2001 |
| EP | 0781917 A | * | 7/1997 |
| JP | 200-87828 | * | 3/2000 |
| JP | 2000 087828 | * | 3/2000 |
| WO | WO 9836170 | * | 1/2001 |

* cited by examiner

*Primary Examiner*—Dinh Q. Nguyen
(74) *Attorney, Agent, or Firm*—Ronald E. Greigg

(57) ABSTRACT

An injection valve for an internal combustion engine including at least a nozzle body, in which a nozzle needle is guided axially displaceably, and an at least one-piece retaining body, in which means for actuating the nozzle needle are disposed. On its circumferential surface, the nozzle body has means for engagement of a centering tool.

7 Claims, 4 Drawing Sheets

INJECTION VALVE

CROSS-REFERENCE TO RELATED APPLICATIONS

This application is a 35 USC 371 application of PCT/DE 02/01092 filed on Mar. 26, 2002.

BACKGROUND OF THE INVENTION

1. Field of the Invention

The invention is directed to an improved injection valve, in particular for an internal combustion engine of a motor vehicle.

2. Description of the Prior Art

One valve of the type with which this invention is covered is known in the industry and can be used in particular in conjunction with common rail injection systems for Diesel engines.

One known injection valve of this type includes a nozzle body, in which a nozzle needle is guided axially displaceably, and which has for instance six openings disposed at defined places, which lead to the combustion chamber of the internal combustion engine and are controlled by means of the nozzle needle. In the installed position of the injection valve, these openings are disposed such that a defined injection angle and a defined injection direction are assured.

The nozzle needle can be triggered by means of a valve-like actuating device, which is disposed in a so-called retaining body. By way of example, the actuating device can be equipped with a piezoelectric actuator unit, which serves to displace a so-called adjusting piston axially; via a hydraulic coupler, the adjusting piston cooperates with a so-called actuating piston, which in turn is connected to a valve closing member in such a way the pressure changes in a so-called valve control chamber can be brought about. The pressure changes in the control chamber lead to an axial displacement of the nozzle needle, as a result of which in turn the openings leading to the combustion chamber of the engine can be opened and closed.

The retaining body as a rule has wrench faces, which serve to fix and adjust the injection valve on a cylinder head of the engine. To enable establishing a defined injection angle, it must be assured that the retaining body and the nozzle body have a defined orientation to one another. Until now, this has been assured by means of centering pins disposed in bores of the retaining body or of the nozzle body.

However, such centering pins are difficult to install and can be sheared off when a nozzle lock nut connecting the retaining body and the nozzle body to one another is tightened.

Moreover, the centering pin bores reduce the high-pressure strength of the nozzle body, which can have an adverse effect especially in common rail injection valves, in which pressures of up to 1.4 kbar prevail. Bore tolerances, in the bores that receive the centering pins, also cause imprecise angular centering of the nozzle body and retaining body.

SUMMARY OF THE INVENTION

The injection valve of the invention in which the nozzle body has means on its circumferential surface for engagement of a centering tool, has the advantage over the prior art that at least for angular orientation or angular centering of the nozzle body relative to the retaining body, centering pins are not needed, since the nozzle body can be oriented relative to the retaining body by means of a centering tool that can be placed against the outside of the nozzle body.

This kind of orientation or centering can be accomplished without problems and with high precision, so that compared to the injection valves of the prior art, easier and better assembly of the injection valve is assured.

Another result is that the bores for the centering pins are omitted, at least in part, with the advantage of increased high-pressure strength of the nozzle body.

In a preferred embodiment of the injection valve of the invention, the means for engagement of the centering tool are embodied as at least one plane face that is disposed on the circumference of the nozzle body. Such a face offers an easy opportunity of engagement of a suitably embodied centering tool, with at least one corresponding centering lug engaging the plane face. For example, the nozzle body can have two plane faces disposed on opposite sides.

An embodiment with only one plane face, however, offers the advantage that the risk is only slight of rotating the nozzle body 180° relative to the retaining body, which would cause misorientation and make the injection valve useless.

However, it is also conceivable to provide the nozzle body, on its circumferential surface, with at least one groove or blind bore-like bore, which can be engaged by a corresponding centering tool.

The nozzle body and retaining body can be joined together via a nozzle lock nut. As a rule, in the region that is covered by the nozzle lock nut, the nozzle body has an increased wall thickness. In order not to impair the high-pressure strength of the nozzle body, the means for engagement of the centering tool are therefore embodied in this region, so that they are at least partly covered by the nozzle lock nut. The pressure-holding capacity of the injection valve is thus assured by the means for engagement of the centering tool, which means can for instance be embodied as ground faces.

If the means for engagement of a centering tool are embodied as at least one place face, then the nozzle body can advantageously be oriented relative to the retaining body in such a way that this face is disposed parallel to wrench faces of the retaining body. However, any other orientation that makes problem-free centering possible is also conceivable.

Further advantages and advantageous refinements of the subject of the invention will become apparent from the description, drawing and claims.

BRIEF DESCRIPTION OF THE DRAWINGS

Exemplary embodiments of the injection valve of the invention are described in detail herein below, with reference to the drawings, in which.

DESCRIPTION OF THE PREFERRED EMBODIMENTS

Figure 1:
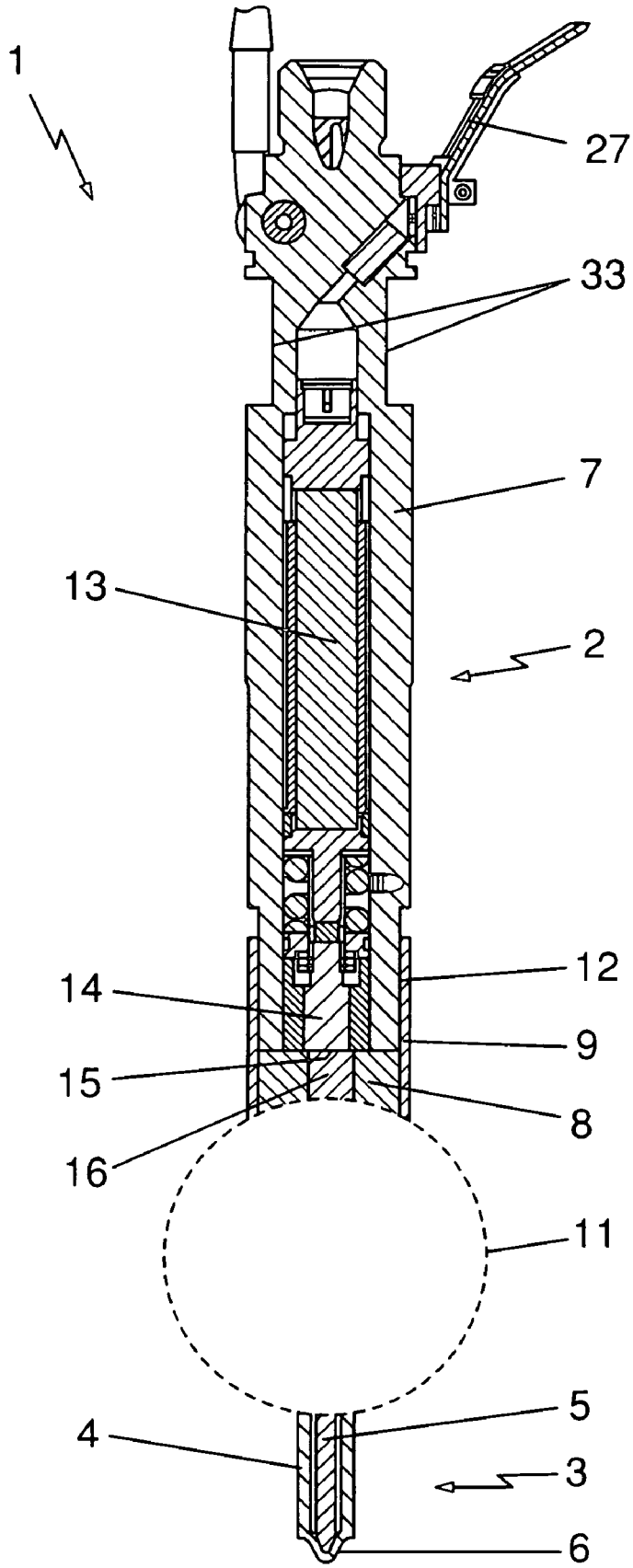
FIG. 1 is a schematic longitudinal section through an injection valve.

The drawing shows an injection valve 1 which is intended in particular for fuel injection into a Diesel internal combustion engine. The injection valve 1 includes a valve control unit 2 and a nozzle unit 3, with a nozzle body 4 in which a nozzle needle 5 is disposed axially displaceably.

The nozzle body 4, on its free end 6, has a plurality of openings, not shown here, by way of which fuel can be injected into a combustion chamber of the engine. The openings are either opened or closed as a function of the position of the nozzle needle 5. That is, an injection event is triggered or stopped by way of the position of the nozzle needle 5.

For actuating the nozzle needle 5, the injection valve 1 has the valve control unit 2, which has both a retaining body 7, provided with wrench faces 33, and a housing part 8 adjoining the retaining body 7 in the axial direction.

Figure 2:
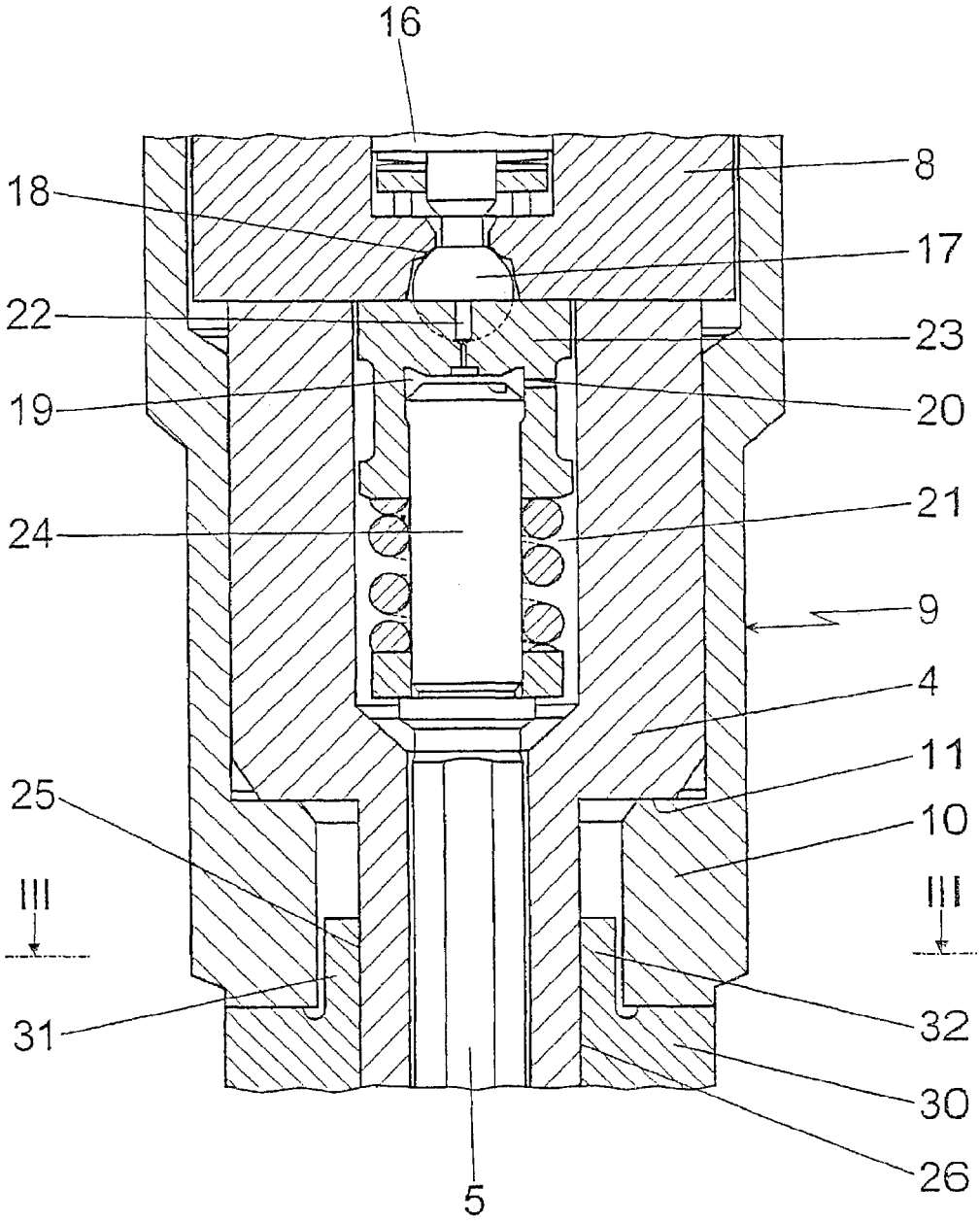
FIG. 2, a detail of the injection valve of FIG. 1, in the region marked II in FIG. 1, in an enlarged view together with a centering tool.

The nozzle body 4, housing part 8 and retaining body 7 are braced together via a nozzle lock nut 9, which rests with a collar 10 (see FIG. 2) on a shoulder 11 of the nozzle body 4 and is fixed to the retaining body 7 via a threaded segment 12. The shoulder 11 and/or the face, resting on the shoulder 11, of the collar 10 of the nozzle lock nut 9 can be coated with a low friction material, such as Teflon®, so that when the nozzle lock nut 9 is tightened only a slight torque is transmitted to the nozzle body 4.

A piezoelectric actuator 13 and a so-called adjusting piston 14, connected to the piezoelectric actuator 13, are disposed in the retaining body 7 of the valve control unit 2. The piezoelectric actuator 13 is connected to a valve controller, not shown here, via electrical lines 27.

The adjusting piston 14 cooperates, via a hydraulic coupler 15, with a so-called actuating piston 16, which is guided in the housing part 8 and is connected to a valve closing member 17. The valve closing member 17 in turn cooperates with a valve seat 18.

By actuation of the valve closing member 17 by means of the piezoelectric actuator 13, the pressure level in a so-called valve control chamber 19 can be adjusted; this chamber is defined on the one hand by a spring plate 23, in which an inlet throttle 20 and an outlet throttle 22 that leads to the valve control unit 2 are embodied, and on the other by a valve control piston 24, which forms a structural unit with the nozzle needle 5 and is embodied as axially displaceable in the spring plate 23. An axial offset of the valve control piston 24 and thus of the nozzle needle 5 can be adjusted by way of changing the pressure level in the valve control chamber 19.

The inlet throttle 20 connects a high-pressure chamber 21, which contains fuel intended for injection into the combustion chamber of the engine, to the valve control chamber 19.

An injection onset, injection duration, and injection quantity are defined by means of the valve control unit 2, by way of the openings disposed on the end 6 of the nozzle unit 3.

To trip an injection event, the valve closing member 17 is actuated by means of the piezoelectric actuator 13, as a result of which fuel can flow out of the valve control chamber 19 via the outlet throttle 22, and the pressure in the valve control chamber 19 drops. As a result, the valve control piston 24 and the nozzle needle 5 connected to it are displaced, so that the openings leading to the combustion chamber are uncovered and fuel is injected into the combustion chamber. Correspondingly, the injection event is stopped by closure of the valve closing member 17.

In the region of the annular collar 10 of the valve lock nut 9, the nozzle body 4 has two plane faces 25 and 26, which are oriented parallel. The two faces 25 and 26 form so-called centering faces, against which a centering tool 30 is positioned. To that end, the centering tool 30 has two centering lugs 31 and 32, which can each be introduced into a respective gap between the annular collar 10 of the valve lock nut 9 and the nozzle body 4 and can thus contact the centering faces 25 and 26, as can be seen from FIG. 2 and FIG. 3.

Figure 3:
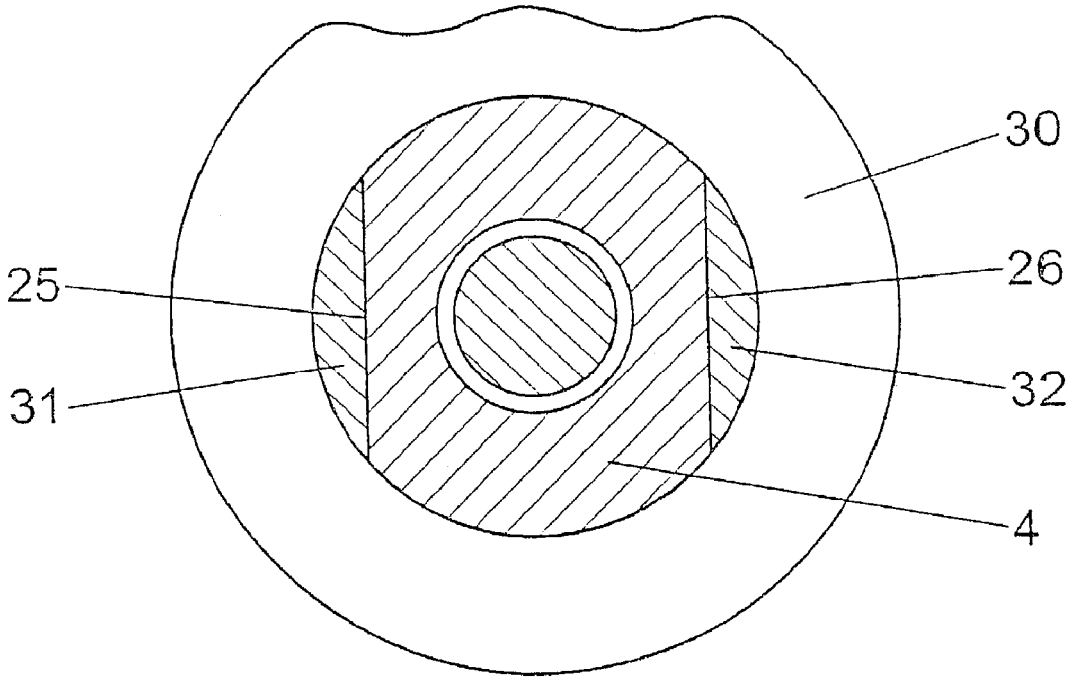
FIG. 3, a simplified cross section through the injection valve of FIGS. 1 and 2 taken along the line III—III in FIG. 2.

In FIG. 3, a cross section can be seen through the nozzle unit 3 and the centering tool 30, with the centering lugs 31 and 32 each engaging a gap. In this view, the nozzle lock nut 9 is not shown.

The centering of the nozzle body 4, or in other words the angular orientation of the nozzle body 4 relative to the retaining body 7, is achieved by providing that the nozzle body 4, by means of the centering tool 30, which via the centering lugs 31 and 32 rests on the centering faces 25 and 26, is rotated relative to the retaining body 7 such that the centering faces 25 and 26 and the wrench faces 33, which are formed on the retaining body, each assume their respective proscribed and required angular position.

By means of the embodiment of the centering faces 25 and 26 on the outside of the nozzle body 4 and because of the resultant possible engagement of the centering tool 30, it is possible to dispense with centering pins between the nozzle body 4 and the housing part 8.

Figure 4:
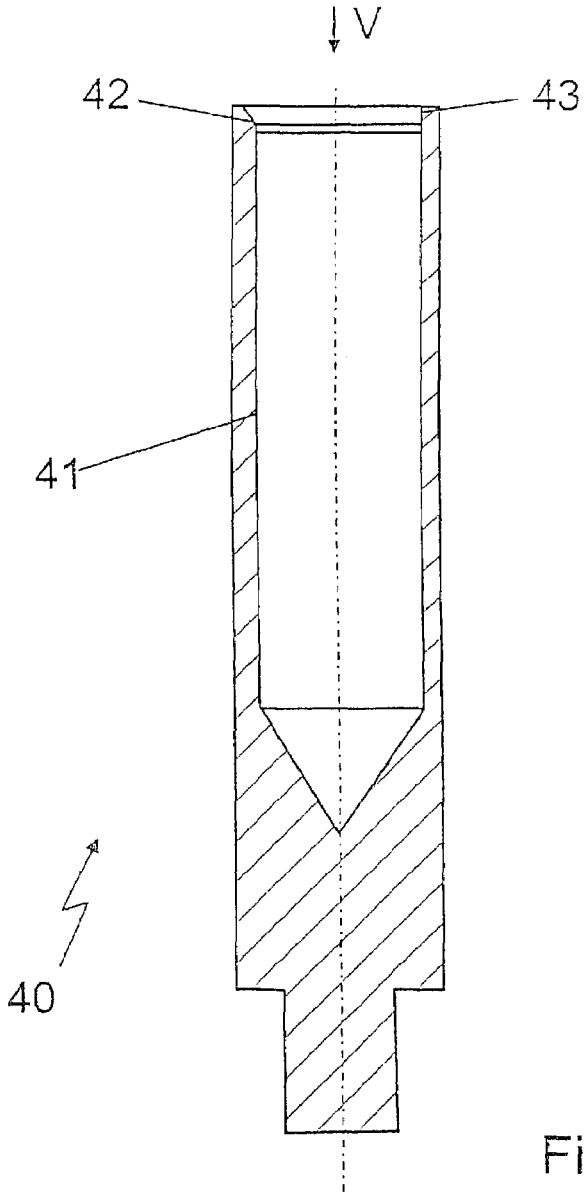
FIG. 4, a simplified view of a centering tool in longitudinal section.
Figure 5:
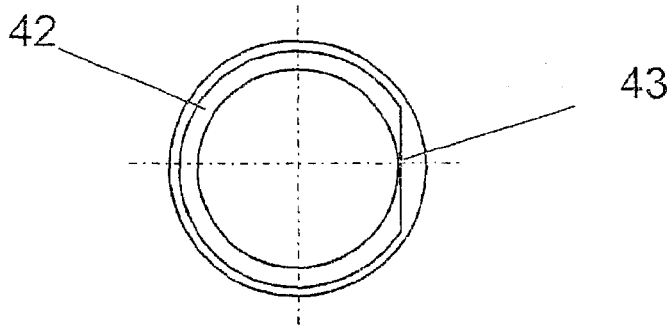
FIG. 5, a plan view on the centering tool of FIG. 4 as indicated by the arrow V in FIG. 4.

In FIGS. 4 and 5, an alternative embodiment of a centering tool 40 is shown, by means of which a nozzle body, not shown here, can be rotated and hence oriented relative to a retaining body of an injection valve.

The centering tool 40 is embodied in cup-shaped fashion and has an axially oriented bore 41, so that the centering tool can be placed against the nozzle body. In the orifice region, the bore 41 of the centering tool 40 has a conical face 42, embodied on the order of a chamfer, which changes over into an axially oriented flat face 43.

For centering the nozzle body relative to the retaining body, the centering tool 40 is placed against the nozzle body, which is preassembled together with the retaining body via a valve lock nut, so that a conical face embodied correspondingly on the nozzle body rests on the conical face 42, and a correspondingly embodied so-called centering lug on the nozzle body rests on the flat face 43. In that case, the nozzle body has only one centering lug.

In the next step, the centering tool 40 is rotated in the circumferential direction until the prescribed angular position has been assumed between the nozzle body and the retaining body. Next, the valve lock nut is tightened, so that the nozzle body and the retaining body are now joined to one another in a manner fixed against relative rotation.

The foregoing relates to preferred exemplary embodiments of the invention, it being understood that other variants and embodiments thereof are possible within the spirit and scope of the invention, the latter being defined by the appended claims.

The invention claimed is:

1. An injection valve for an internal combustion engine, comprising at least a nozzle body (4), a nozzle needle (5) guided axially displaceably in the nozzle body, an at least one-piece retaining body (7), and means for actuating the nozzle needle (5) disposed in the retaining body, the nozzle body (4), on its circumferential surface, having means (25,26) for engagement of a centering tool (30) provided for the alignment of the nozzle body (4) and the at least one-piece retaining body (7), wherein the nozzle body (4) and the retaining body (7) are joined to one another and fixed relative to one another via a nozzle lock nut (9).

2. The injection valve of claim 1, wherein the means for engagement of the centering tool (30) is embodied as at least one plane face (25, 26) disposed on the circumference of the nozzle body (4).

3. The injection valve of claim 1, wherein the nozzle lock nut at least partly covering the means (25, 26) for engagement of the centering tool (30).

4. The injection valve of claim 2, wherein the nozzle lock nut at least partly covering the means (25, 26) for engagement of a centering tool (30).

5. The injection valve of claim 2, wherein the retaining body (7) comprising at least two wrench faces (33) oriented substantially parallel to the means, embodied as at least one plane face (25, 26), for engagement of a centering tool (30).

6. The injection valve of claim 3, wherein the retaining body (7) comprising at least two wrench faces (33) oriented substantially parallel to the means, embodied as at least one plane face (25, 26), for engagement of a centering tool (30).

7. The injection valve of claim 5, wherein the retaining body (7) comprising at least two wrench faces (33) oriented substantially parallel to the means, embodied as at least one plane face (25, 26), for engagement of a centering tool (30).

* * * * *